United States Patent [19]

Weirich et al.

[11] 4,306,822

[45] Dec. 22, 1981

[54] HYDRAULIC CONTROL MEANS

[75] Inventors: Walter Weirich, Dortmund; Harry Rosenberg, Lüdinghausen, both of Fed. Rep. of Germany

[73] Assignee: Gewerkschaft Eisenhutte Westfalia, Lunen, Fed. Rep. of Germany

[21] Appl. No.: 61,116

[22] Filed: Jul. 26, 1979

[30] Foreign Application Priority Data

Jul. 27, 1978 [DE] Fed. Rep. of Germany ..... 2832875

[51] Int. Cl.[3] ..... E21D 23/16

[52] U.S. Cl. ..... 405/294; 91/170 MP

[58] Field of Search ..... 91/170 MP; 405/293, 405/294, 302

[56] References Cited

U.S. PATENT DOCUMENTS

| | | | |
|---|---|---|---|
| 3,728,863 | 4/1973 | Hidasi | 405/294 |
| 4,002,036 | 1/1977 | Jeffrey et al. | 405/293 |
| 4,041,714 | 8/1977 | Allen | 405/293 |

*Primary Examiner*—William F. Pate, III

*Attorney, Agent, or Firm*—Sughrue, Mion, Zinn, Macpeak and Seas

[57] ABSTRACT

Hydraulic control means are provided for controlling an auxiliary shield positioned at one side of the roof shield of a mine roof support unit. The auxiliary shield is moved laterally of its roof shield by means of three hydraulic rams and the roof shield is supported by hydraulic props. The hydraulic control means comprises a control valve device and two pilot check valves. One pilot check valve is positioned in a line leading from the control valve device to two hydraulic rams which act in tandem. The other pilot check valve is positioned in a line leading from the control valve device to the other hydraulic ram. The pilot check valves are actuated in dependence upon the pressurization of the hydraulic props whereby the hydraulic rams are depressurised when the props are pressurized and vice versa.

10 Claims, 2 Drawing Figures

HYDRAULIC CONTROL MEANS

BACKGROUND TO THE INVENTION

This invention relates to hydraulic control means for an auxiliary shield positioned at the side of a protective shield of a mine roof support unit.

It is known to provide a mine roof support unit with an auxiliary shield which can be moved laterally thereof to seal the gap between that unit and the adjacent unit. Such an auxiliary shield is usually positioned at the side of the roof shield, but it could also be positioned at the side of the goaf shield of the roof support unit. Such an auxiliary shield is moved either by springs or by hydraulic rams. Such auxiliary shields can also be used to assist the process of guiding and aligning the roof support units when they are advanced to follow up the advance of the face being won (see DE-OS No. 2 032 208 and DE-AS No. 2 210 757).

DE-AS No. 2 350 482 discloses hydraulic control means for such an auxiliary shield, the hydraulic control means being constituted by pilot-controlled two-way valves and manually-operated control valves. The arrangement is such that the rams associated with the auxiliary shield are automatically connected to a high pressure line when the props of the adjacent roof support unit are relieved of load, and are automatically connected to a return line when those props are pressurised. In order that such a roof support unit can be aligned, the rams associated with the auxiliary shield manually-operable control valve device, it is possible to guide and align an unloaded roof support unit even when its auxiliary shield is "hydraulically locked".

Advantageously, the control valve device is constituted by two control valves for each hydraulic ram, one control valve controlling extension of its respective hydraulic ram and the other control valve controlling retraction of that ram. Preferably, the or each pilot check valve is positioned in a line leading from said one control valve associated with a given hydraulic ram to that hydraulic ram.

The invention also provides a mine roof support unit comprising a roof shield supported by hydraulic props, an auxiliary shield positioned at one side of the roof shield, at least one hydraulic ram for moving the auxiliary shield laterally of the roof shield, and hydraulic control means for controlling the movement of the auxiliary shield, wherein the hydraulic control means is as defined above.

Preferably, the or each hydraulic ram is double-acting.

Advantageously, there are three hydraulic rams and two pilot check valves, one hydraulic ram being associated with one pilot check valve and two control valves, and the other two hydraulic rams being associated with the other pilot check valve and two control valves. With this arrangement, not only can the auxiliary shield be moved out have to be double-piston rams, the pressurisation of one piston of which is controlled by way of the pilot-controlled two-way valves, the pressurisation of the other piston being effected by way of the manually-operated valves. One disadvantage of this arrangment is that double-piston rams are required. Another disadvantage is that control of the auxiliary shield of one roof support unit proceeds in dependence upon the pressurisation of the props of the adjacent roof support unit. Moreover, the rams associated with each auxiliary shield can only be actuated together, so that only limited alignment of the roof support units is possible.

The aim of the invention is to provide hydraulic control means for the auxiliary shield of a mine roof support unit, which control means does not suffer from these disadvantages.

SUMMARY OF THE INVENTION

The present invention provides hydraulic control means for controlling an auxiliary shield positioned at one side of a protective shield of a mine roof support unit, the auxiliary shield being provided with at least one hydraulic ram for moving the auxiliary shield laterally of the roof support unit, and the protective shield being supported by means of hydraulic props, the hydraulic control means comprising a control valve device and at least one pilot check valve, the or each pilot check valve being positioned in a line connecting the control valve device to a respective hydraulic ram, wherein the or each pilot check valve is actuated in dependence upon the pressurisation of the hydraulic props whereby the or each hydraulic ram is depressurised when the hydraulic props are pressurised and the or each hydraulic ram is pressurised when the hydraulic props are depressurised.

With this form of hydraulic control means, the hydraulic ram(s) is (or are) automatically depressurised when the roof support unit is bearing load. Thus, the auxiliary shield "floats" relatively freely with respect to its protective shield, contact with the protective shield of the adjacent roof support unit being maintained by means of springs which bias the auxiliary shield outwardly. When the roof support unit is relieved of load (by depressurising its hydraulic props), the hydraulic ram(s) is (or are) automatically pressurised so that the auxiliary shield is "hydraulically locked" in its extended position in which it bears against the protective shield of the adjacent roof support unit. Where the mine working is inclined, each roof support unit has its auxiliary shield at that side lower down the incline so that, when a given unit is relieved of load, its "hydraulically locked" auxiliary shield is supported against the adjacent roof support unit (which is under load) so that the given unit cannot tilt or slide down the incline. However, by using a laterally relative to the roof shield and parallel thereto, but it can also be tilted slightly with respect to the roof shield.

Preferably, the auxiliary shield is of L-shaped cross-section, one arm of the L being a sliding fit within the roof shield, and the other arm of the L forming an abutment for the or each hydraulic ram. This construction prevents the auxiliary shield being jammed between the roof shield and the roof of the mine working when the roof support unit is under load.

BRIEF DESCRIPTION OF THE DRAWINGS

The invention will now be described in greater detail, by way of example, with reference to the accompanying drawings, in which.

DESCRIPTION OF PREFERRED EMBODIMENT

Figure 1:
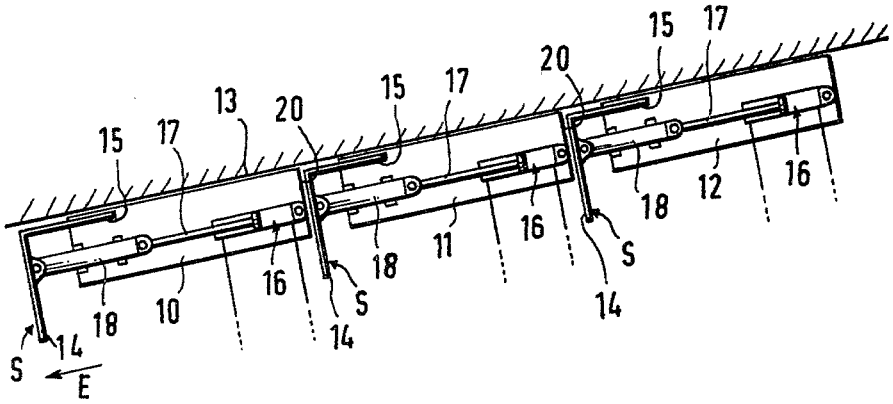
FIG. 1 is a diagrammatical representation of the roof shields of three adjacent roof support units, and shows the associated auxiliary shields together with their hydraulic rams.

Referring to the drawings, FIG. 1 shows the box-section roof shields 10, 11 and 12 of three mine roof support units which are positioned side-by-side along an inclined mine working (not shown). The direction of the mine working incline is indicated by the arrow E. The roof shields 10, 11 and 12 are forced against, and so support, the roof 13 of the mine working by means of hydraulic props (not shown). Each roof shield 10, 11 and 12 is provided with an auxiliary shield S which can be moved laterally thereof to seal the gap between two adjacent roof shields. Each of the auxiliary shields S is arranged on that side of its roof shield which is lower down the inclined working. Each roof shield S is constituted by an L-shaped metal sheet having a downwardly-extending arm 14 and an arm 15 at right-angles thereto. Each arm 15 extends into the corresponding roof shield so as to lie just below the uppermost (roof-engaging) surface of that roof shield. Hydraulic double-acting rams 16 are housed within each of the box-section roof shields 10, 11 and 12, the rams 16 being connected to the corresponding arms 14 of the auxiliary shields S by means of piston rods 17 and tubular guide members 18. The tubular guide members 18 are pivotally attached to the corresponding arms 14. Each of the guide members is constituted by a pair of telescopic tubes which are spring biassed apart so that the corresponding auxiliary shield S is urged outwardly towards the side face 20 of the roof shield immediately lower down the incline.

Figure 2:
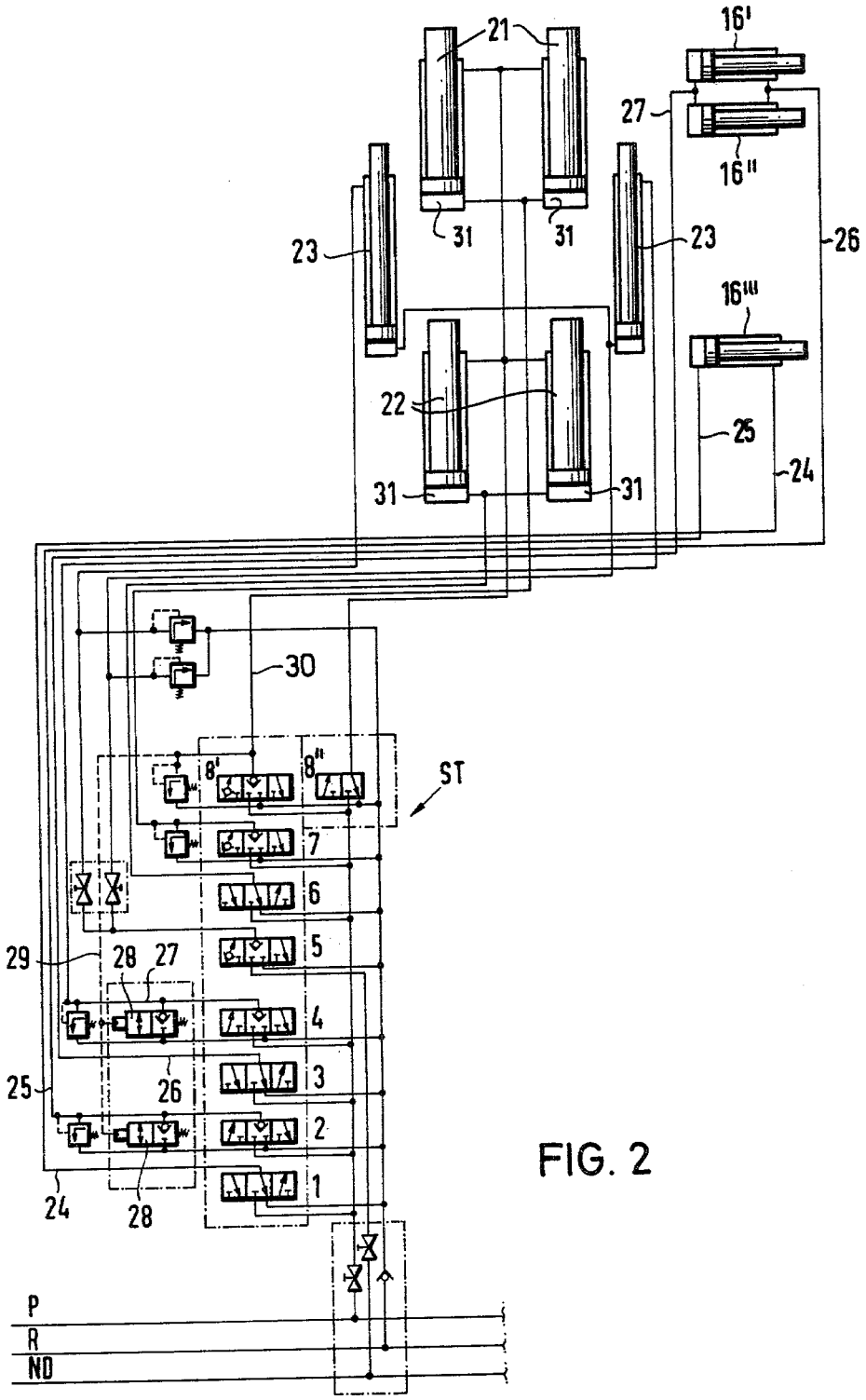
FIG. 2 is a circuit diagram of the hydraulic control means for one of the roof support units of FIG. 1.

Each roof support unit is provided with separate hydraulic control means for controlling its auxiliary shield S, one such control means being shown in FIG. 2. Here, the roof support unit concerned has four hydraulic props, namely two front props 21 and two rear props 22. The roof support unit also has two hydraulic advance rams 23 for advancing that unit to follow up the advance of the face being won. The auxiliary shield of this unit is actuated by means of the double-acting hydraulic rams 16', 16'' and 16'''.

All the hydraulic props 21 and 22 and the hydraulic rams 16', 16'' and 16''' and 23 are controlled by means of a control valve device ST having eight manually-controlled control valves 1 to 8 whose inputs are connectible to a return line R. The inputs of the rams 23 are also connectible to a low pressure line ND, and the inputs of the props 21 and 22 and the rams 16', 16'' and 16''' are connectible to a high pressure line P. The lines P, R and ND extend along the mine working and communicate hydraulically with the control valve devices of all the roof support units.

The output side of the control valve 1 is connected, via a line 24, to one working chamber of the ram 16'''. Similary, the output side of the control valve 2 is connected, via a line 25, to the other working chamber of the ram 16'''. Thus, by actuating the control valves 1 and 2, the ram 16''' is caused to retract and extend respectively.

The output sides of the control valves 3 and 4 are connected, via respective lines 26 and 27, to the working chambers of the rams 16' and 16'', so that actuation of these control valves causes simultaneous retraction or extension of these rams. Similarly, the control valves 5 and 6 serve to actuate the advance rams 23, and the control valves 7 and 8 serve to actuate the props 21 and 22. The control valve 8 is constituted by two valves 8' and 8'', the control valve 7 serving to extend the rear props 22, the valve 8' serving to extend front props 21 and the valve 8'' serving to retract all four props.

A respective pilot check valve 28 is provided at the output side of each of the control valves 2 and 4, these check valves being connected between the respective lines 25 and 27 and the return line R. The actuating pistons of these pilot check valves 28 are connected, by means of a common line 29, to the line 30 which connects the output of the control valve 8 to the working chambers 31 which extend the props 21. Thus, when the props 21 are extended, the line 30 is pressurised so that the pistons of the pilot check valves 28 are pushed in owing to the resultant pressure in the line 29. This connects the lines 25 and 27 to the return line 2 and so switches the rams 16', 16'' and 16''' to a floating condition, in which they are free to move inwards without restriction. When the props 21 (and 22) are extended, therefore, the auxiliary shields can easily be retracted. However, the springs associated with the guide members 18 are sufficiently powerful to hold the auxiliary shield S in contact with the adjacent side face 20 (see FIG. 1) of the roof shield of the roof support unit immediately lower down the inclined mine working. Inward (retracting) movement of the auxiliary shield S is, therefore, only possible by overcoming the resistance offered by the springs associated with the guide members 18.

When the props 21 and 22 are relieved of load ready for retraction, their working chambers 31 are relieved of hydraulic pressure. Thus, the line 30 and the control line 29 are also relieved of pressure, so that the pistons of the pilot check valves 28 are pushed out by their springs to the positions shown in FIG. 2, in which the lines 25 and 27 are isolated from the return line R. This means that the rams 16', 16'' and 16''' are hydraulically locked so that the auxiliary shield S cannot be retracted. The springs associated with the guide members 18 do, however, permit a certain degree of movement of the auxiliary shields, so that, as the roof support unit is advanced to follow the advance of the face being won, its auxiliary shield S does not jam in the gap between its roof shield and that of the roof support unit immediately lower down the incline. Moreover, with the props 21 and 22 relieved of pressure, the rams 16', 16'' and 16''' can be selectively retracted and extended by hand with the aid of the control valves 1 to 4, so as to align the associated roof support unit with the adjacent roof support units. In this connection, it is possible to pressurise the ram 16''' independently of the two rams 16' and 16'' (which are operated simultaneously). This enables the auxiliary shield S to be angled slightly with respect to the direction of advance.

As soon as the roof support unit is advanced and correctly aligned, its props 21 and 22 are extended, which causes the pilot check valves to reverse so as to bring the rams 16', 16'' and 16''' into their floating condition.

We claim:

1. In a mine roof support unit comprising a roof shield supported by hydraulic props, an auxiliary shield positioned at one side of the roof shield, at least one hydraulic ram for moving the auxiliary shield laterally of the roof shield, and hydraulic control means for controlling the movement of the auxiliary shield, the hydraulic control means comprising a control valve device and at least one pilot check valve, the improvements comprising: positioning said at least one pilot check valve in a respective line connecting the control valve device to a respective hydraulic ram, and actuating said at least one pilot check valve in dependence upon the pressurisation of the hydraulic props to depressurize said at least one hydraulic ram to a floating condition when the hydraulic props are pressurised, and to pressurize said at least one hydraulic ram to a hydraulically locked condition when the hydraulic props are depressurised.

2. Hydraulic control means according to claim 1, wherein the control valve device is constituted by two control valves for each hydraulic ram, one control valve controlling extension of its respective hydraulic ram and the other control valve controlling retraction of that ram.

3. Hydraulic control means according to claim 2, wherein said at least one pilot check valve is positioned in a respective line leading from said one control valve associated with a given hydraulic ram to that hydraulic ram.

4. A mine roof support unit comprising a main roof shield supported by hydraulic props, an auxiliary shield positioned at one side of the roof shield, at least one hydraulic ram for moving the auxiliary shield laterally of the roof shield, and hydraulic control means for controlling the movement of the auxiliary shield, wherein the hydraulic control means comprises a control valve device and at least one pilot check valve, said at least one pilot check valve being positioned in a respective line connecting the control valve device to a respective hydraulic ram, wherein said at least one pilot check valve is actuated in dependence upon the pressurisation of the hydrauic props to depressurise said at least one hydraulic ram to a floating condition when the hydraulic props are pressurised, and to pressurize said at least one hydraulic ram to a hydraulically locked condition when the hydraulic props are depressurised.

5. A roof support unit according to claim 4, wherein the control device is constituted by two control valves for each hydraulic ram, one control valve controlling extension of its respective hydraulic ram and the other control valve controlling retraction of that ram.

6. A roof support unit according to claim 5, wherein said at least one hydrauic ram is double-acting.

7. A roof support unit according to claim 5, wherein there are three hydraulic rams, and two pilot check valves, one hydraulic ram being associated with one pilot check valve and two control valves, and the other two hydraulic rams being associated with the other pilot check valve and two control valves.

8. A roof support unit according to claim 4, wherein the auxiliary shield is spring-biassed laterally away from the roof shield.

9. A roof support unit according to claim 4, wherein the auxiliary shield is L-shaped cross-section, one arm of the L being a sliding fit within the roof shield, and the other arm of the L forming an abutment for said at least one hydraulic ram.

10. A roof support unit according to claim 4, wherein the actuating piston of said at least one pilot check valve is controlled by the hydraulic pressure in a line connected to the pressure line leading to the hydraulic props.

* * * * *